United States Patent [19]

Martin et al.

[11] Patent Number: 4,875,590

[45] Date of Patent: Oct. 24, 1989

[54] FOLDABLE DISPLAY

[75] Inventors: Gregory G. Martin, East Jordan; Thomas J. Nook, Grand Haven, both of Mich.

[73] Assignee: Harbor Industries, Grand Haven, Mich.

[21] Appl. No.: 118,859

[22] Filed: Nov. 9, 1987

[51] Int. Cl.[4] ..... A47F 7/00

[52] U.S. Cl. ..... 211/55; 211/195; 211/128

[58] Field of Search ..... 211/55, 130, 128, 195; 248/441.1

[56] References Cited

U.S. PATENT DOCUMENTS

| | | | |
|---|---|---|---|
| 457,598 | 8/1891 | Briggs | 211/55 X |
| 907,171 | 12/1908 | Knight | 211/195 X |
| 939,807 | 11/1909 | Collins | 211/55 X |
| 1,453,598 | 5/1923 | Obele | 211/195 X |
| 1,879,943 | 9/1932 | Miller . | |
| 2,067,051 | 1/1937 | Hall . | |
| 2,368,909 | 2/1945 | Wright . | |
| 2,545,255 | 3/1951 | Broce . | |
| 3,777,897 | 12/1973 | Gray . | |

FOREIGN PATENT DOCUMENTS

| | | |
|---|---|---|
| 2821122 | 11/1979 | Fed. Rep. of Germany . |
| 1482997 | 8/1977 | United Kingdom . |

OTHER PUBLICATIONS

Gibson-Buzza Assembly Brochure (No Date).

*Primary Examiner*—Sarah A. Lechok

*Attorney, Agent, or Firm*—Price, Heneveld, Cooper, DeWitt & Litton

[57] ABSTRACT

A display assembly which is adjustable between an open display and a flat storage position which includes a rack member adapted to support items for display thereon in the display position, at least one leg having an end which is pivotally connected to the rack member, and a base pivotally connected to the other end of the leg and adjustably positioned such that the base underlies and supports the rack member and the leg in the display position, and is received between the rack member and the leg in the storage position. The display assembly further includes a releasable latch structure which releasably locks the rack member to the base in the display position to thereby form a triangular configuration.

9 Claims, 4 Drawing Sheets

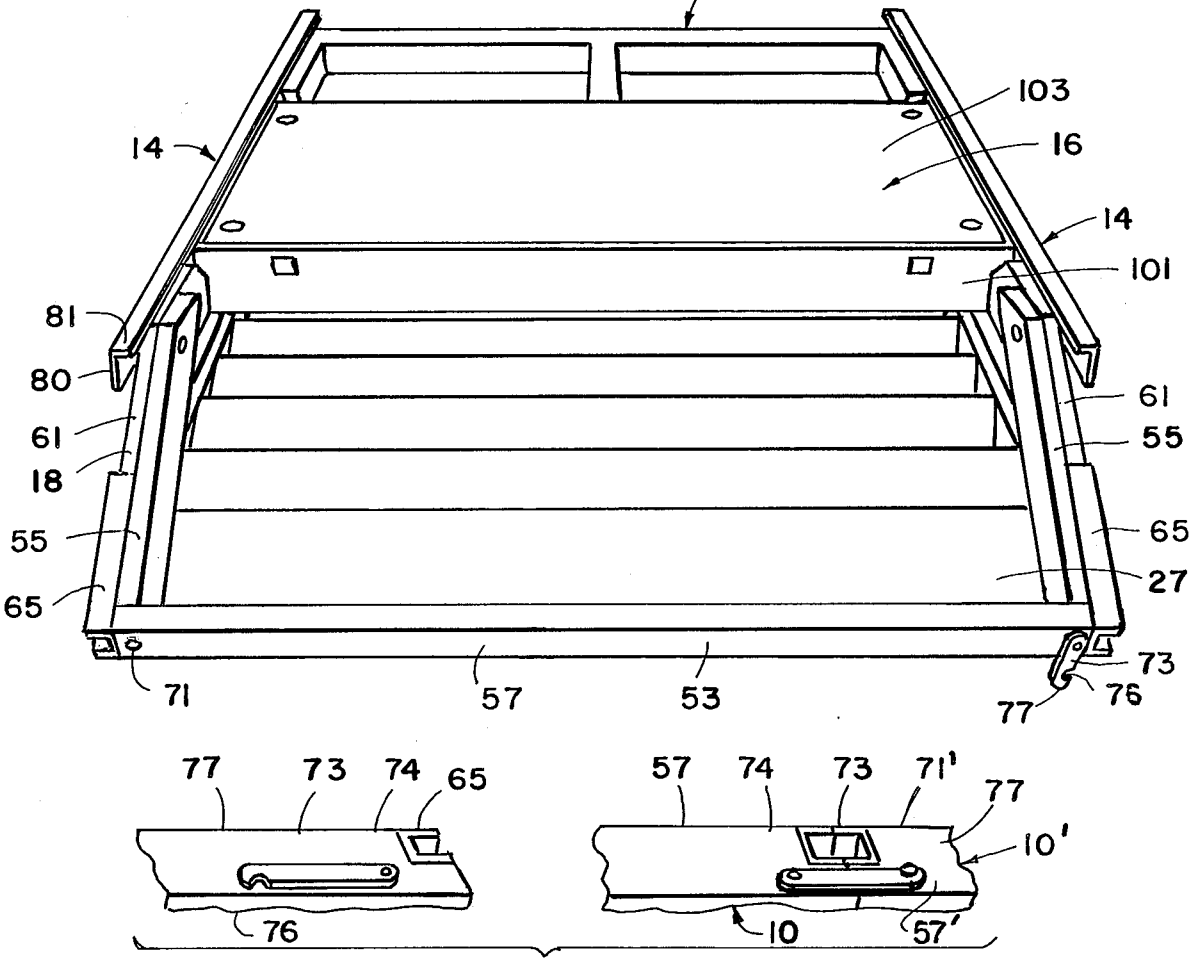
FIG. 7
FIG. 11
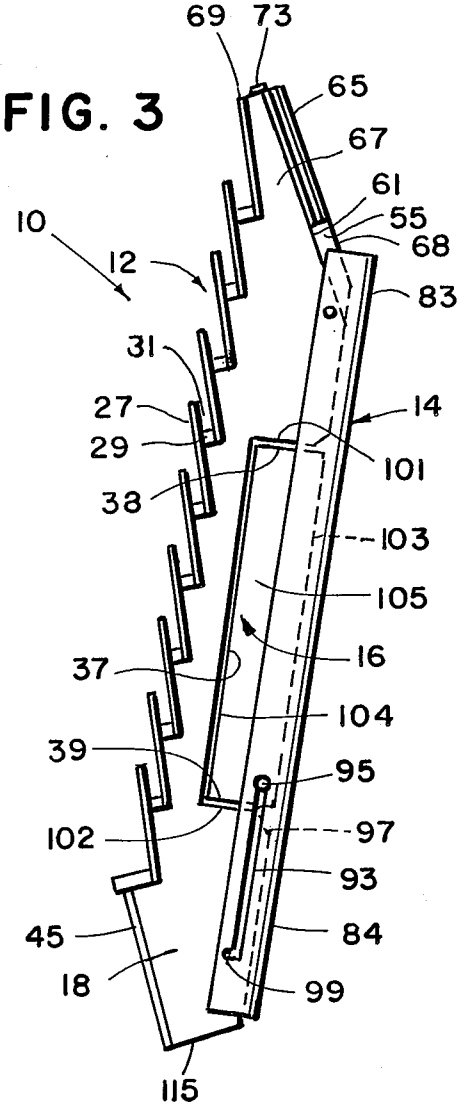
FIG. 3

FOLDABLE DISPLAY

BACKGROUND OF THE INVENTION

The present invention pertains to displays and in particular, to a display specially suited for greeting cards, wrapping paper and the like.

In retail establishments, it is desirable to obtain display units which will effectively and attractively display the goods offered for sale. In addition, it is advantageous to have a unit which may further be broken down to thereby ease and lessen shipping expenses and effort, and also to enable the unit to be easily moved about the store, relocated to a different store or placed into storage.

Past artisans have developed knock-down display units which are generally fastened together through the use of bolts, screws or the like. While these units may be reduced to a small size for shipping or moving purposes, they also entail a considerable expenditure of effort and time to erect. More specifically, time must be spent determining how the various parts are to be assembled, in addition to the actual assembling process itself. In the moving of a unit to a different location in the store or elsewhere, the retailer is faced with also having to disassemble the unit. Moreover, the various fasteners utilized to assemble the unit, such as bolts or the like, must be kept track of to ensure that they will not become lost or erroneously used in the subsequent erection of the display unit. This problem is especially acute if the unit is to be stored for any length of time before reassembling.

SUMMARY OF THE INVENTION

In accordance with the present invention, a unique display assembly is provided which effectively displays various goods for retail, and yet is easily and efficiently foldable between a flat storage position and an open display position.

Essentially, the display assembly includes a rack member upon which items such as greeting cards, wrapping paper, etc. may be placed for an attractive and efficient display, at least one supporting leg which is pivotally attached to the rack member, and a base which is pivotally attached to the supporting leg. The base member is adjustably oriented between a folded position in which it is received within a recess between the rack member and the leg to so form the flat storage position, and an open position in which the base underlies the rack member and the leg to thereby support the same in the open display position.

By using the display assembly of the present invention, the aforementioned difficulties encountered in shipping, erection and subsequent moving or storage are obviated. The present display assembly is foldably positionable into a flat storage position thereby enabling easy shipping and efficient storage. Further, the assembly is erected with minimal time, effort or expertise, since it is simply folded open and oriented into a supporting display posture. No assembling together of various parts, nor any use of loose fasteners (e.g. bolts) are needed. The mere folding of the assembly's components also facilitates an easy closing process for the assembly, whereby it may be easily moved or stored. Hence, the present display assembly may be efficiently shipped due to its flat storage position, quickly and easily erected by a simple folding operation, or easily moved and stored once at a retail establishment by easily foldably closing and eliminating the concern of losing the various fasteners heretofore required.

BRIEF DESCRIPTION OF THE DRAWINGS

FIG. 3 is a side view of the display assembly, shown in a flat or folded storage position;

FIG. 7 is a perspective view of the display assembly, shown in the flat or folded storage position;

FIG. 11 is a perspective view of top surfaces of adjacent display assemblies illustrating the arrangement by which one display assembly interconnects with an adjacent display assembly.

DETAILED DESCRIPTION OF THE PREFERRED EMBODIMENT

For purposes of description herein, the terms "upper,""lower,""right,""left,""rear,""front,""vertical,""horizontal," and derivatives thereof shall relate to the invention as oriented in FIGS. 3–6. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions, and other physical characteristics relating to the embodiments disclosed herein, are not to be considered as limiting, unless the claims expressly state otherwise.

Figure 2:
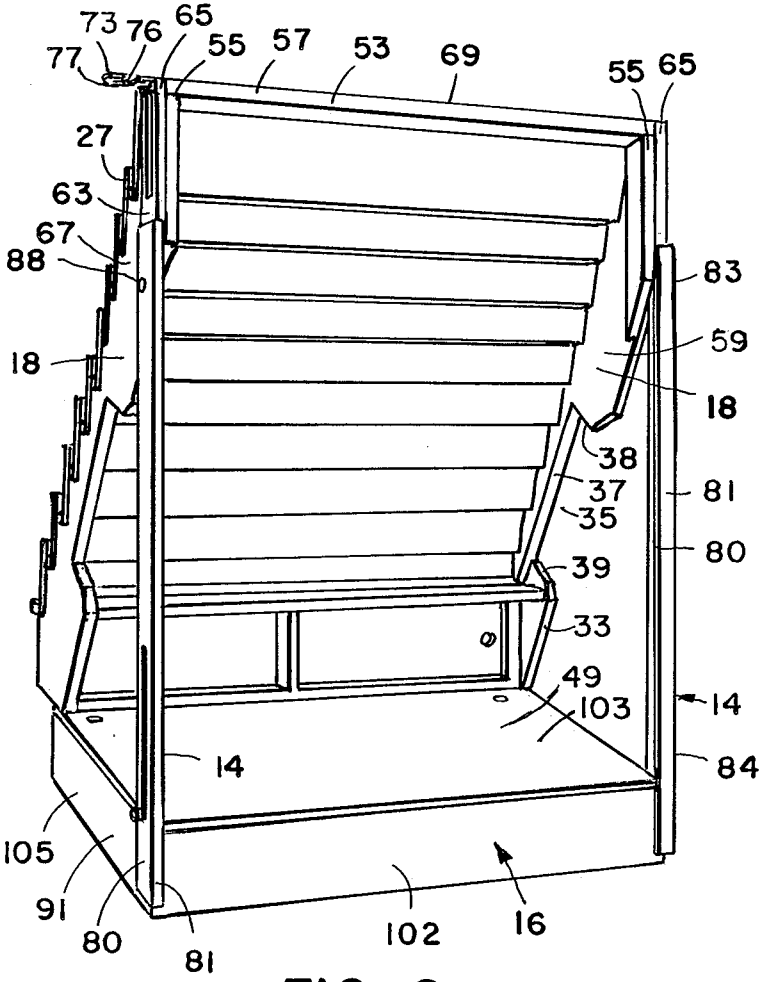
FIG. 2 is a perspective view of a rearward side of the display assembly.
Figure 1:
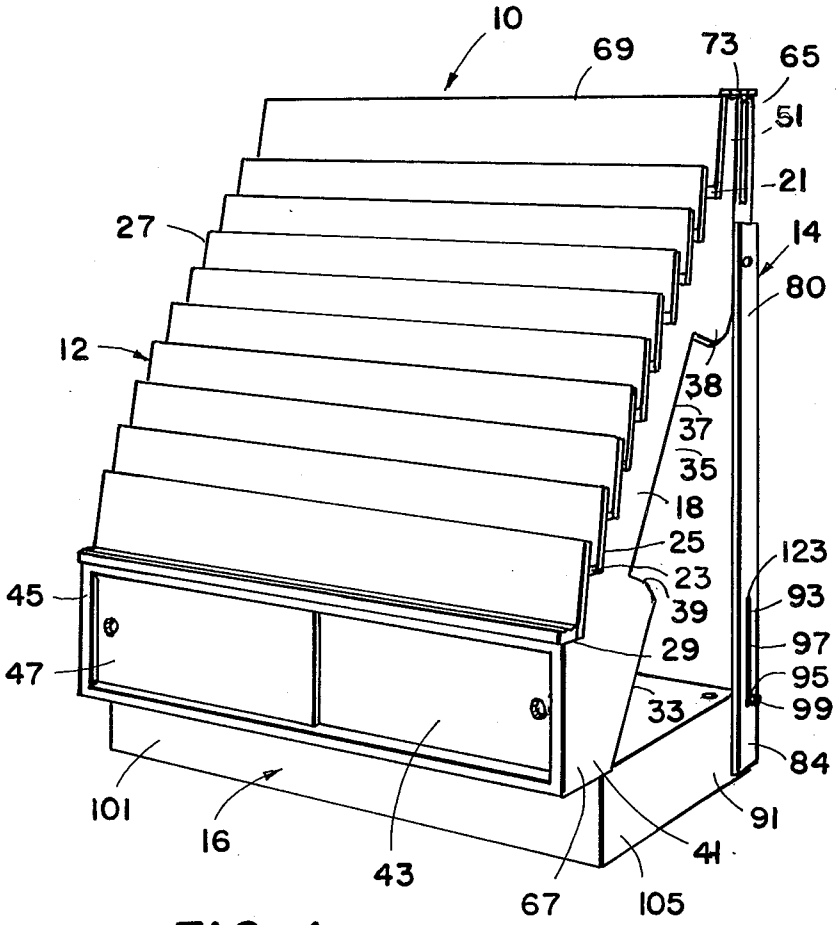
FIG. 1 is a perspective view of a forward portion of a display assembly embodying the present invention.

In the preferred embodiment, a display assembly 10 which facilitates easy and efficient shipping, erection, and subsequent moving or storage includes a rack member 12 adapted to support thereon various items for display, at least one supporting leg 14 and a base 16 (FIGS. 1 and 2). These components are pivotally interconnected and positionable between a flat or folded storage position and an open or unfolded display position. Display assembly 10 is preferably composed of aluminum and particle board, but could of course be composed of a variety of other materials possessing the requisite characteristics.

Rack member 12 (FIG. 1) typically comprises a pair of spaced apart side panels 18 which project upwardly at an inclination of approximately 50–85 degrees in the display position. Each side panel 18 includes a forward edge 21 which has a generally stair-step configuration.

The stair-step configuration is defined by a plurality of first and second orthogonally positioned surfaces 23, 25 (FIGS. 1 and 4) which are inclined approximately 5–20 degrees to either side of the horizontal and 5–20 degrees to the vertical, respectively. Further, first surfaces 23 are generally shorter in length than second surfaces 25.

Attached to second surfaces 25 and projecting upwardly in a parallel relationship therefrom are a plurality of strips 27. Strips 27 are elongate plates which extend the entire distance between side panels 18 and thereby form sidewalls for containing the items to be displayed. Also extending between side panels 18 and attached to first surfaces 23 are a plurality of slats 29. Slats 29 are designed to act as the bottom support for the items to be displayed. Hence, strips 27 and slats 29 cooperate to define a plurality of elongate pockets 31 in which are placed the various items for display, such as greeting cards, wrapping paper or the like.

Opposite forward edge 21 of each side panel 18 is rearward edge 33 (FIGS. 1 and 4) which extends substantially the entire length of side panel 18. Provided intermediately thereof is a rectangular recess 35 which is adapted to receive therein base 16 when folded into the storage position. Recess 35 is defined by a recessed edge 37 which is substantially parallel to rearward edge 33, and upper and lower edges 38, 39 extending at right angles thereto (FIGS. 3–6).

At lower end 41 (FIG. 1) of rack member 12 is a drawer structure 43. Drawer structure 43 includes a forward face 45 which is oriented substantially vertically in the display position. Forward face 45 typically includes a pair of sliding doors 47 which permit a user access to a storage area 49 therebehind (FIG. 2). Storage area 49 may be utilized to hold, for instance, surplus items to be displayed.

Attached to upper end 51 of rack member 12 is a generally U-shaped framework 53 which includes a pair of downwardly extending legs 55 and an upper bight portion 57 (FIG. 2). Legs 55 are preferably secured to inner surfaces 59 of side panels 18 and are positioned to extend slightly beyond back edges 61 thereof. This arrangement, then, defines elongate notches 63 along legs 55 and back edges 61.

Received within each notch 63 is a channel shaped rail 65 (FIG. 2) which is secured to and extends along leg 55 a short distance. Rails 65 are of approximately the same dimensions as notches 63, and therefore, do not project beyond outer surfaces 67 of side panels 18 or rearward wall 68 of framework 53. In the display position, rails 65 are vertically oriented to receive therein shafts supporting, for example, a sheet of advertising indicia (not illustrated).

Bight portion 57 of framework 53 extends across the distance between side panels 18 and thereby forms the top of rack member 12. Mounted to top surface 69 thereof, near one side panel 18 is a knob 71, and near the opposite side panel 18 is a connecting tang 73 (FIGS. 7 and 11). Tang 73 is pivotally secured to framework 53 by pin 74 and includes an arcuate cut-out 76 near a distal end 77 thereof. Tang 73 functions to hook together two adjacent display assemblies 10, 10' to form a continuous row of assemblies for display purposes; that is, arcuate cut-out 76 of tang 73 is received about knob 71 provided on an adjacent assembly 10'.

Pivotally coupled to upper end 51 of rack member 12 are a pair of supporting legs 14 (FIGS. 1–6 and 10). Legs 14 are preferably comprised of angle members having first and second flanges 80, 81 to thereby supply additional supporting strength, and upper and lower ends 83, 84. At upper end 83, first flange 80 is oriented to be substantially parallel to side panel 18 and positioned flush against outer surface 67 thereof. Also in the upper end 83, first flange 80 is provided with a hole 86 through which is received a pivot pin 88. Pivot pin 88 may be affixed to side panels 18 or may be received through a corresponding opening therein. Of course, these arrangements are merely examples, and other known arrangements to pivotally couple rack member 12 with legs 14 could be utilized.

Figure 10:
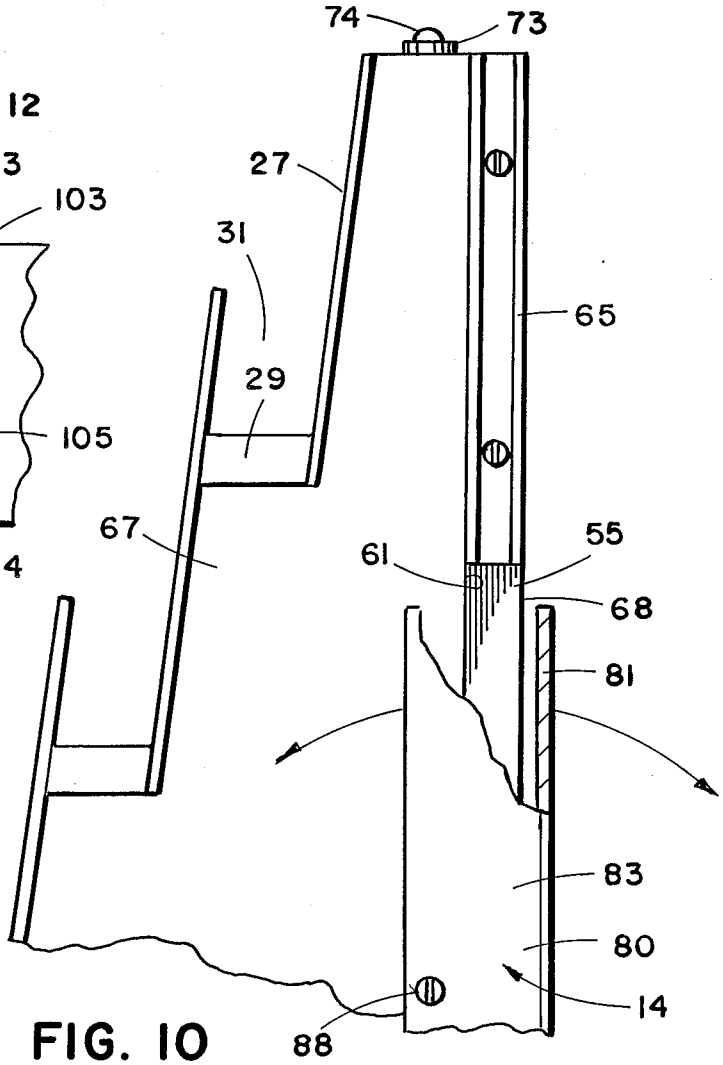
FIG. 10 is an enlarged, partially broken side view of the pivotal connection between the supporting leg and the rack.

Second flange 81 of each leg 14 projects inwardly at a right angle to first flange 80 a distance less than the width of side panels 18. As seen in FIG. 10, leg 14 is mounted to side panel 18 such that second flange 81 is generally spaced from back edge 61, in order to permit leg 14 to pivot to either side of the vertical position. Hence, second flange 81 is received into and out of notch 63, below rail 65, as leg 14 pivots about pin 88.

Figure 9:
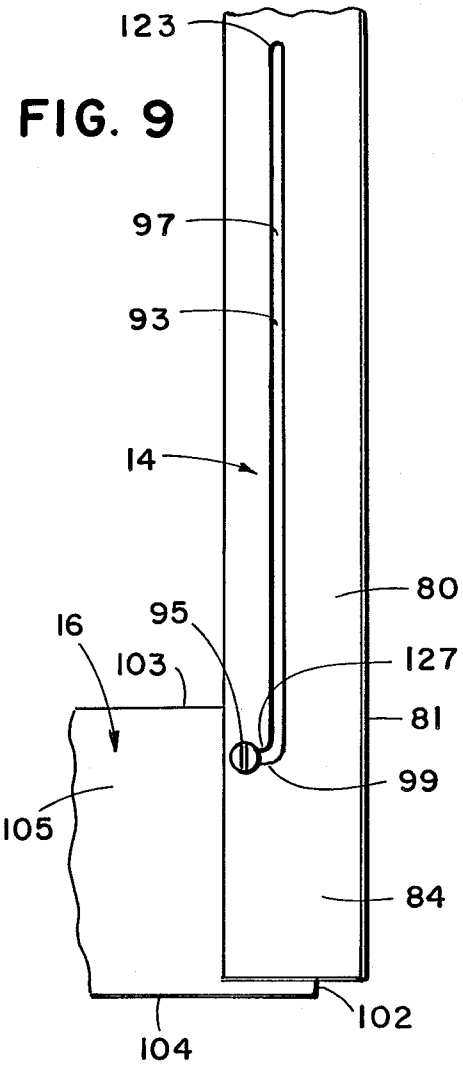
FIG. 9 is an enlarged side view of an adjustable connection between the base and a supporting leg portion of the display assembly.

Lower end 84 of leg 14 is adjustably coupled to rearward end 91 of base 16 through the use of slot 93 and pin 95 (FIG. 9). Slot 93 includes an elongate leg portion 97 which extends longitudinally along first flange 80, and a short foot portion 99 which extends transversely thereon. Pin 95 is received therethrough and may be either fixedly secured to base 16 or received through a corresponding opening therein. Of course, as with pin 88, the connection could be made by any known manner.

Base 16 (FIG. 2) is preferably quadrangular in plan shape and includes a forward wall 101, a rearward wall 102, a top surface or face 103, a bottom face 104 and a pair of opposite sidewalls 105. First flanges 80 of legs 14 are positioned substantially parallel to sidewalls 105 and in engagement therewith. Further, legs 14 are secured to sidewalls 105 such that second flanges 81 are spaced apart from base 16, to thereby permit base 16 to pivot about pin 95.

Figure 8:
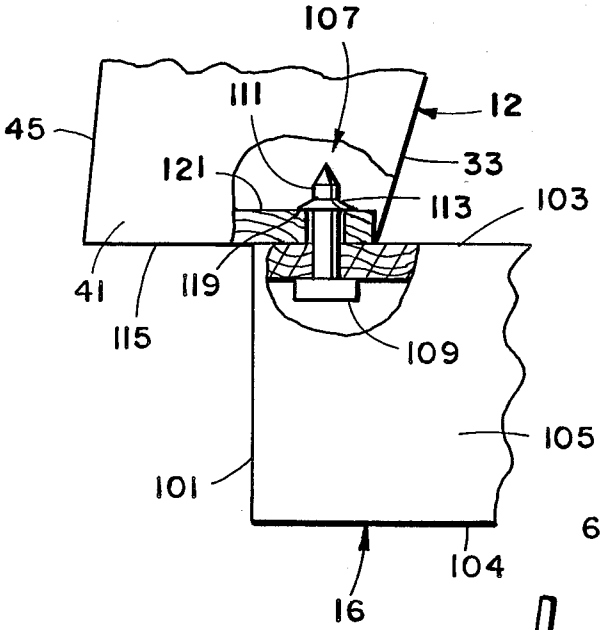
FIG. 8 is an enlarged, partially broken side view of a releasable latch means securing a rack portion of the display assembly to a base portion of the display assembly.

Projecting above top face 103 adjacent forward end 101 is a releasable latch structure 107 which is preferably in the form of a pair of locking pins 109 (FIG. 8). Locking pins 109 are fixedly mounted to top face 103 of base 16 and have a shank 111 which projects upwardly therefrom a short distance. Circumscribing shank 111 is provided at least one resilient lip 113 which extends radially outwardly from shank 111 at a downward inclination toward top face 103. Cooperating with pins 109, in bottom surface 115 of rack 12, is provided a pair of openings 117 which are designed to receive therein locking pins 109. More specifically, each shank 111 is inserted into and through one opening 117 such that lip 113 is flexed inwardly as it passes therethrough. Due to the resilient nature of lip 113, it biases outwardly, once cleared of opening 117, and engages inner face 119 of rack member 12 with its annular distal rim 121. Although locking pin 109 is illustrated with one resilient lip 113, a plurality of similar lips, provided along the length of shank 111, could be provided to ensure that a lip would pass through opening 117 and engage inner face 119. Additionally, lip 113 is sufficiently flexible, to permit rack member 12 to be readily disengaged therefrom. Preferably, locking pins 109 are composed of a suitable synthetic resin such as nylon or the like, but could be composed of a variety of materials possessing the requisite characteristics. Of course, the disclosed locking pin arrangement is merely illustrative of the many known releasable latch structures which could be utilized.

Display assembly 10, in its flat, storage position (FIG. 3), is oriented such that rack member 12, legs 14 and base 16 are folded together into substantially parallel relationships with each other. Base 16 is received into recess 35 and positioned between rack member 12 and legs 14. More specifically, base 16 is pivotally and longitudinally oriented such that pin 95, joining legs 14 to base 16, is received into leg portion 97 of slot 93 and abuts end wall 123 thereof. Top face 103 is positioned toward and substantially parallel to second flanges 81 of legs 14. In this position, then, bottom face 104, forward wall 101 and rearward wall 102 of base 16 are substantially received with recess 35, and juxtaposed to recessed edge 37, upper edge 38 and lower edge 39, respectively. This particular orientation of base 16 permits leg portion 97 of slot 93 to be at a minimum length, so that the structural integrity of legs 14 is not jeopardized.

Figure 6:
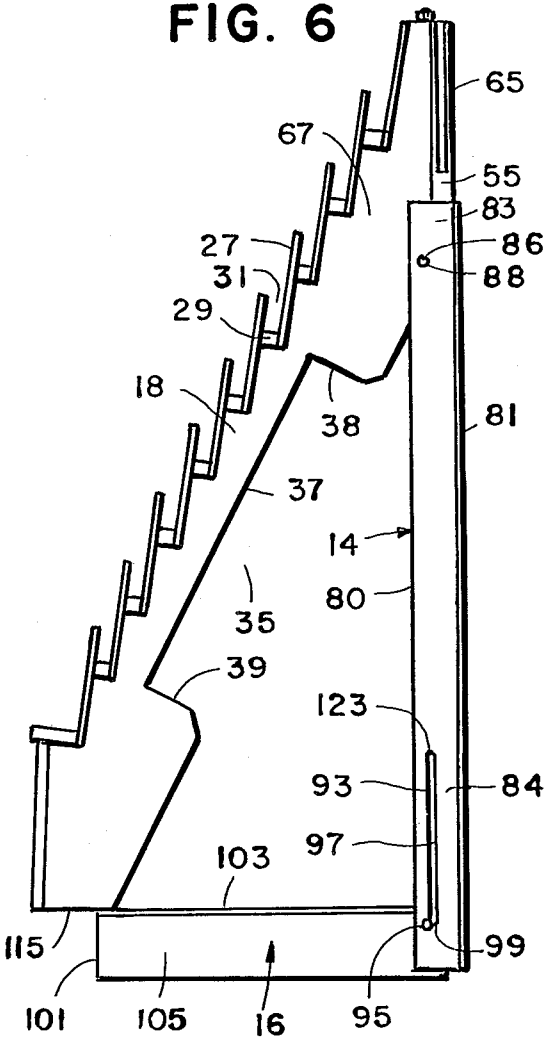
FIG. 6 is a side view of the display assembly, shown in an open or unfolded and completely erected position.
Figure 5:
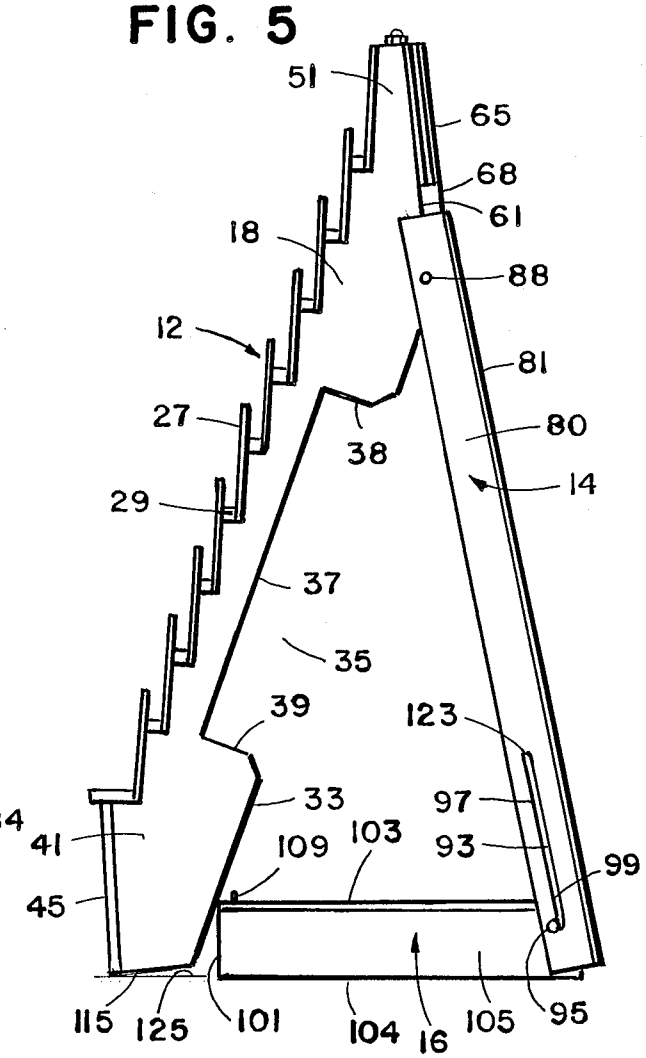
FIG. 5 is a side view of the display assembly, shown in an open or unfolded, but not completely erected position.
Figure 4:
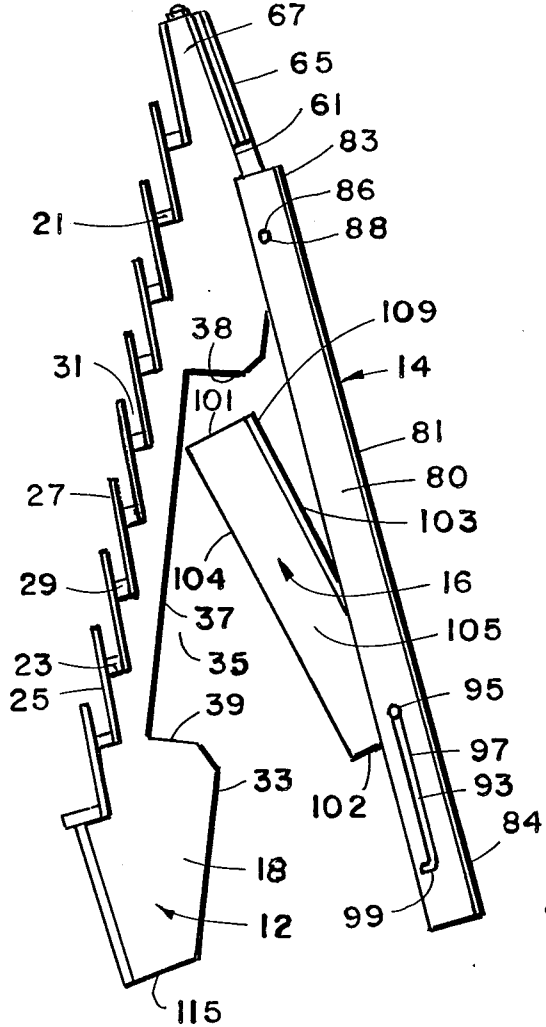
FIG. 4 is a side view of the display assembly, shown in a partially open or unfolded position.

The erection of display assembly 10 at, for instance, a retail establishment may be accomplished in a quick and easy manner. Initially, legs 14 and rack member 12 are opened by pivotally moving the respective parts from their substantially parallel relationship to a V-shaped configuration. As the parts begin to separate base 16 may begin to pivot outwardly, as seen in FIG. 4. Once rack member 12 and legs 14 have been separated to substantially their maximum extent, wherein second flange 81 abuts back edge 61 of rack member 12 (FIG. 5), base member 16 may be positioned on a floor surface or the like 125. At this point, legs 14 are adjusted so that pin 95 is received within foot portion 99 of slot 93. The upper borders 127 of foot portions 99, then, serve as the supports for legs 14 through pins 95. The last step entails lifting and rocking rack member 12 up onto top face 103 of base 16 such that it is releasably locked thereto by locking pins 109 (FIG. 6). Subsequent closing to the flat, storage position would essentially entail the same steps performed in the reverse order.

Of course, it is understood that the above descriptions are those of preferred embodiments of the invention. Various other embodiments, as well as many changes and alterations, may be made without departing from the spirit and broader aspects of the invention as defined in the claims.

The embodiments of the invention in which an exclusive property or privilege is claimed are defined as follows:

1. A collapsible display assembly which is adjustable between an open display position and a flat storage position, wherein said assembly comprises:

a rack member adapted to support items for display thereon in said display position, said rack member having an upper end, a lower end and a side extending between said ends;

at least one leg having first and second opposite ends, said first end being pivotally connected to said rack member adjacent the upper end thereof;

a base having a forward edge and a rearward edge, said base being pivotally connected to said second end of said leg at said rearward edge and means for adjustably positioning said rearward edge along said leg such that said base underlies and supports said rack member and said leg in said open display position with said lower end of said rack member resting on said base adjacent said forward edge, and wherein said base is received between said rack member and said leg in said flat storage position; and releasable latch means for coupling said base and said rack member in said display position and which permits said rack member and said base to be manually detached without the use of tools when in said flat storage position.

2. The display assembly of claim 1 in which said releasable latch means includes at least one locking pin affixed to one of said base and said rack member and is provided with at least one resilient lip, and at least one corresponding opening in the other of said base and said rack member which receives said pin and lip therethrough so that the lip and pin interconnect the base and rack member in a locking relationship.

3. A collapsible display assembly which is adjustable between an open display position and a flat storage position, wherein said assembly comprises:

a rack member adapted to support items for display thereon in said display position;

at least one leg having first and second opposite ends, said first end being pivotally connected to said rack member;

a base pivotally connected to said second end of said leg and adjustably positioned such that said base underlies and supports said rack member and said leg in said open display position, and wherein said base is received between said rack member and said leg in said flat storage position; and a first pivot pin pivotally connecting said leg and said base, said first pivot pin being adjustable longitudinally along said leg such that said base moves pivotally and longitudinally to said leg when said assembly is adjusted between said display and storage positions, said rack member including an intermediate recess which is adapted to receive said base in said storage position, whereby said assembly may be folded into a substantially flat configuration in said storage position, said rack member further including a drawer structure which is oriented between said recess and said base in said display position, and to one side of said base and said rack member in said storage position.

4. A collapsible display assembly which is positionable between a flat storage position and an open display position, wherein said assembly comprises:

a base having a forward and rearward end;

a rack member for supporting items for display thereon, said rack member resting on said forward end of said base in said display position and having a recess adapted to receive said base in said storage position;

at least one leg having an upper end and a lower end, said leg being pivotally connected to said rack at said upper end of said leg;

adjustable means on said leg and said base for pivotally connecting said base to said lower end of said leg and for adjustably positioning said base rearward end along said leg; and releasable latch means on said base forward end and said rack for releasably coupling said base and said rack member in said display position and which permits said rack member and said base to be manually detached from said rack when in said flat storage position, whereby said assembly is foldably positioned between said flat storage position wherein said base is received in said recess between said rack member and said leg and a display position wherein said base underlies and supports said rack member and said leg and collectively defines therewith a triangular configuration.

5. The display assembly of claim 4 in which said base includes a top surface that faces toward said leg and said rack member in said display position and that faces toward said leg alone in said storage position.

6. The display assembly of claim 4 in which said adjustable means includes a first pivot pin pivotally connecting said leg and said base and wherein said leg defines an L-shaped slot receiving said pivot pin, said first pivot pin being adjustable longitudinally along said leg such that said base moves pivotally and longitudinally to said leg when said assembly is adjusted between said display and storage positions.

7. A collapsible display assembly which is positionable between a flat storage position and an open display position, wherein said assembly comprises:

a base having a forward and rearward end;

a rack member for supporting items for display thereon, releasably coupled to said forward end of said base in said display position and having a recess adapted to receive said base in said storage position;

at least one leg pivotally connected to said rack member and said rearward end of said base, whereby said assembly is foldably positioned between said flat storage position wherein said base is received in said recess between said rack member and said leg and a display position wherein said base underlies and supports said rack member and said leg and collectively defines therewith a triangular configuration; and a first pivot pin pivotally connecting said leg and said base, said first pivot pin being adjustable longitudinally along said leg such that said base moves pivotally and longitudinally to said leg when said assembly is adjusted between said display and storage positions, said rack member including a drawer structure which is oriented between said recess and said base in said display position and to one side of said base and said recess in said storage position.

8. The display assembly of claim 4 in which said releasable latch means includes a locking pin on said base, said pin including a resilient lip, said rack member defining an opening which receives said pin and said lip therethrough, said lip and said pin releasably holding said rack member and said base in a locking relationship.

9. The display assembly of claim 4 in which said rack member includes an upper surface provided with a knob near one side thereof and a pivotal tang having a cut-out on the opposite side thereof, whereby adjacent assembly may be coupled together by connecting said tang of one assembly with said knob of the other assembly.

* * * * *